US011408421B2

(12) United States Patent
Ma et al.

(10) Patent No.: US 11,408,421 B2
(45) Date of Patent: Aug. 9, 2022

(54) SCROLL COMPRESSOR

(71) Applicant: Danfoss (Tianjin) Ltd., Tianjin (CN)

(72) Inventors: Lin Ma, Tianjin (CN); Wenhu Yao, Tianjin (CN); Kun Qian, Tianjin (CN); Bin Wang, Tianjin (CN)

(73) Assignee: Danfoss (Tianjin) Ltd., Tianjin (CN)

( * ) Notice: Subject to any disclaimer, the term of this patent is extended or adjusted under 35 U.S.C. 154(b) by 218 days.

(21) Appl. No.: 16/666,984

(22) Filed: Oct. 29, 2019

(65) Prior Publication Data

US 2020/0141408 A1 May 7, 2020

(30) Foreign Application Priority Data

Nov. 5, 2018 (CN) ..... 201821813123.7

(51) Int. Cl.
*F04C 15/00* (2006.01)
*F04C 18/02* (2006.01)
(Continued)

(52) U.S. Cl.
CPC ..... *F04C 18/02* (2013.01)

(58) Field of Classification Search
CPC .... F04C 18/02; F04C 15/0003; F04C 27/001; F04C 27/003; F04C 27/004; F04C 27/005; F04C 27/008
See application file for complete search history.

(56) References Cited

U.S. PATENT DOCUMENTS 5,800,133 A * 9/1998 Ikeda ..... F04B 39/00 417/269
6,488,489 B2 12/2002 Williams et al.
(Continued)

FOREIGN PATENT DOCUMENTS

CN 1374458 A 10/2002
CN 1670335 A 9/2005
(Continued)

OTHER PUBLICATIONS

First Examination Report for Indian Patent Application No. 201914038093 dated Dec. 1, 2020.

*Primary Examiner* — Deming Wan
(74) *Attorney, Agent, or Firm* — McCormick, Paulding & Huber PLLC

(57) ABSTRACT

The present invention discloses a scroll compressor. At least two shrink belts (23', 23", 26, 26', 28, 28') are provided around the outer periphery of said fixed scroll between the outer periphery of said fixed scroll (2) and the inner wall surface of the upper cap (1) of the scroll compressor. The at least two shrink belts are annular, and are in interference fit between the outer periphery of said fixed scroll and the inner wall surface of the upper cap. The at least two shrink belts include a main shrink belt (23', 23", 28) and an assistant shrink belt (26, 26', 28'). The main shrink belt and the assistant shrink belt are arranged side by side in the axial direction, that is, in the vertical direction of the fixed scroll, and the main shrink belt and the assistant shrink belt are spaced apart from each other by a distance. In this way, it is allowed to add other special structure (e.g., an additional fluid passage) to the fixed scroll, reduce the deformation of the fixed scroll, and improve the performance and the reliability of the scroll compressor.

20 Claims, 11 Drawing Sheets

(51) Int. Cl.
*F04C 27/00* (2006.01)
*F04C 27/02* (2006.01)

(56) References Cited

U.S. PATENT DOCUMENTS

| | | | | |
|---|---|---|---|---|
| 6,547,543 | B2 | 4/2003 | Sun et al. | |
| 7,070,401 | B2 | 7/2006 | Clendenin et al. | |
| 10,107,290 | B2 * | 10/2018 | Hagita | F04C 29/12 |
| 2007/0134117 | A1 | 6/2007 | Liang et al. | |
| 2008/0101973 | A1 * | 5/2008 | Iwano | F04C 18/0215 418/55.1 |

FOREIGN PATENT DOCUMENTS

| | | | |
|---|---|---|---|
| CN | 1952401 | A | 4/2007 |
| CN | 1955482 | A | 5/2007 |
| CN | 101037995 | A | 9/2007 |
| JP | 2009-228437 | A | 10/2009 |
| WO | 88/01353 | A1 | 2/1988 |

* cited by examiner

SCROLL COMPRESSOR

CROSS-REFERENCE TO RELATED APPLICATION

This application claims foreign priority benefits under U.S.C. § 119 to Chinese Patent Application No. 201821813123.7 filed on Nov. 5, 2018, the content of which is hereby incorporated by reference in its entirety.

BACKGROUND OF THE INVENTION

1. Technical Field

The present invention relates to a scroll compressor.

2. Background

In many cases, sealing between a high pressure side chamber and a low pressure side chamber of a scroll compressor is achieved by providing a shrink belt between the fixed scroll and the upper cap, and by performing interference heating ASM of the fixed scroll, the shrink belt and the upper cap. In order to reduce the deformation of the fixed scroll, the location of the shrink belt is designed to be close to the bottom surface of the fixed scroll.

However, in some cases, it is required to add additional fluid passage(s) in the outer periphery of said fixed scroll. In this case, in order to prevent interference between the shrink belt and the fluid passage, it is necessary to adjust the location of the shrink belt, more specifically, to adjust the height at which the center plane of the shrink belt is located in the vertical direction. As a result, such adjustment may cause an increase in the amount of deformation of the fixed scroll, resulting in a reduction in the performance and the reliability of the scroll compressor.

In order to suppress the amount of deformation of the fixed scroll, technical solutions of increasing the strength of the material of the fixed scroll or increasing the size of the fixed scroll have been proposed. However, these technical solutions would significantly increase the manufacturing cost of the scroll compressor or increase the overall size of the scroll compressor, and thus are not desirable solutions.

SUMMARY

In order to improve the performance and the reliability of the scroll compressor, the present invention provides a scroll compressor, comprising an upper cap in which a fixed scroll is disposed. At least two shrink belts are provided around an outer periphery of said fixed scroll between the outer periphery of said fixed scroll and an inner wall surface of the upper cap.

The at least two shrink belts are annular, and are in interference fit between the outer periphery of said fixed scroll and the inner wall surface of the upper cap.

The at least two shrink belts comprise a main shrink belt and an assistant shrink belt. The respective cross section of the main shrink belt and the assistant shrink belt is a circle or a part of a circle.

The main shrink belt and the assistant shrink belt are arranged side by side in an axial direction of said fixed scroll (i.e., in the vertical direction), and the main shrink belt and the assistant shrink belt are spaced apart from each other by a distance such that annular space is enclosed by the main shrink belt, the inner wall surface of the upper cap, the assistant shrink belt, and the outer periphery of said fixed scroll together.

A radius of the cross section of the main shrink belt is larger than the radius of the cross section of the assistant shrink belt.

At least one notch may be disposed on the assistant shrink belt, thereby allowing the annular space to communicate with a space external to the assistant shrink belt.

The fixed scroll has a disc-shaped main body, a through hole at the center of the main body, a wrap extending downward from the lower surface of the main body, and a plurality of mounting portions located around the wrap.

The assistant shrink belt is located above or below the main shrink belt.

In the axial direction (i.e., the vertical direction) of the fixed scroll, the height at which the main shrink belt is located is higher than the height at which the top surface of the wrap is located, and the height at which the assistant shrink belt is located is lower than the height at which the top surface of the wrap is located.

The plurality of mounting portions are located below the outer periphery of said fixed scroll, and a fluid passage is provided in the outer periphery of said fixed scroll and at least one of the plurality of mounting portions.

The scroll compressor further comprises a middle housing and a base. The middle housing is provided on the base, and the upper cap is provided on the middle housing. A fluid inlet is disposed on the middle housing, and an orbiting scroll cooperating with the fixed scroll is disposed inside the middle housing. A pressure chamber is enclosed by the fixed scroll and the upper cap, and a fluid outlet is disposed on the upper cap so that fluid enters the middle housing via the fluid inlet, then enters the pressure chamber via a through hole disposed at the center of the fixed scroll, and finally is discharged to the external of the scroll compressor via the fluid outlet disposed on the upper cap.

One of the fixed scroll and the inner wall surface of the upper cap is formed integrally with the shrink belts.

As an option, the shrink belts and the inner wall surface of the upper cap are formed integrally, and the shrink belts are formed by the inner wall surface of the upper cap protruding towards the fixed scroll.

Alternatively, the shrink belts are separate members relative to the fixed scroll and the inner wall surface of the upper cap, and grooves are formed on one of the outer periphery of said fixed scroll and the inner wall surface of the upper cap, in which the shrink belts are embedded.

Alternatively, the shrink belts are separate members relative to the fixed scroll and the inner wall surface of the upper cap, and the shrink belts are welded on one of the outer periphery of said fixed scroll and the inner wall surface of the upper cap.

By adopting the technical solution as above-mentioned, the present invention is able to restrain the deformation of the fixed scroll effectively in a simple and economic way, and improve the performance and the reliability of the scroll compressor.

BRIEF DESCRIPTION OF THE DRAWINGS

In order to facilitate understanding of the present invention, the present invention will be described in more detail below based on exemplary embodiments and in conjunction with the accompanying drawings. The same or similar reference numerals are used in the accompanying drawings to denote the same or similar components. It should be understood that the accompanying drawings are merely schematic and that the sizes and scales of the components in the accompanying drawings may not necessarily be precise.

DETAILED DESCRIPTION

Figure 1:
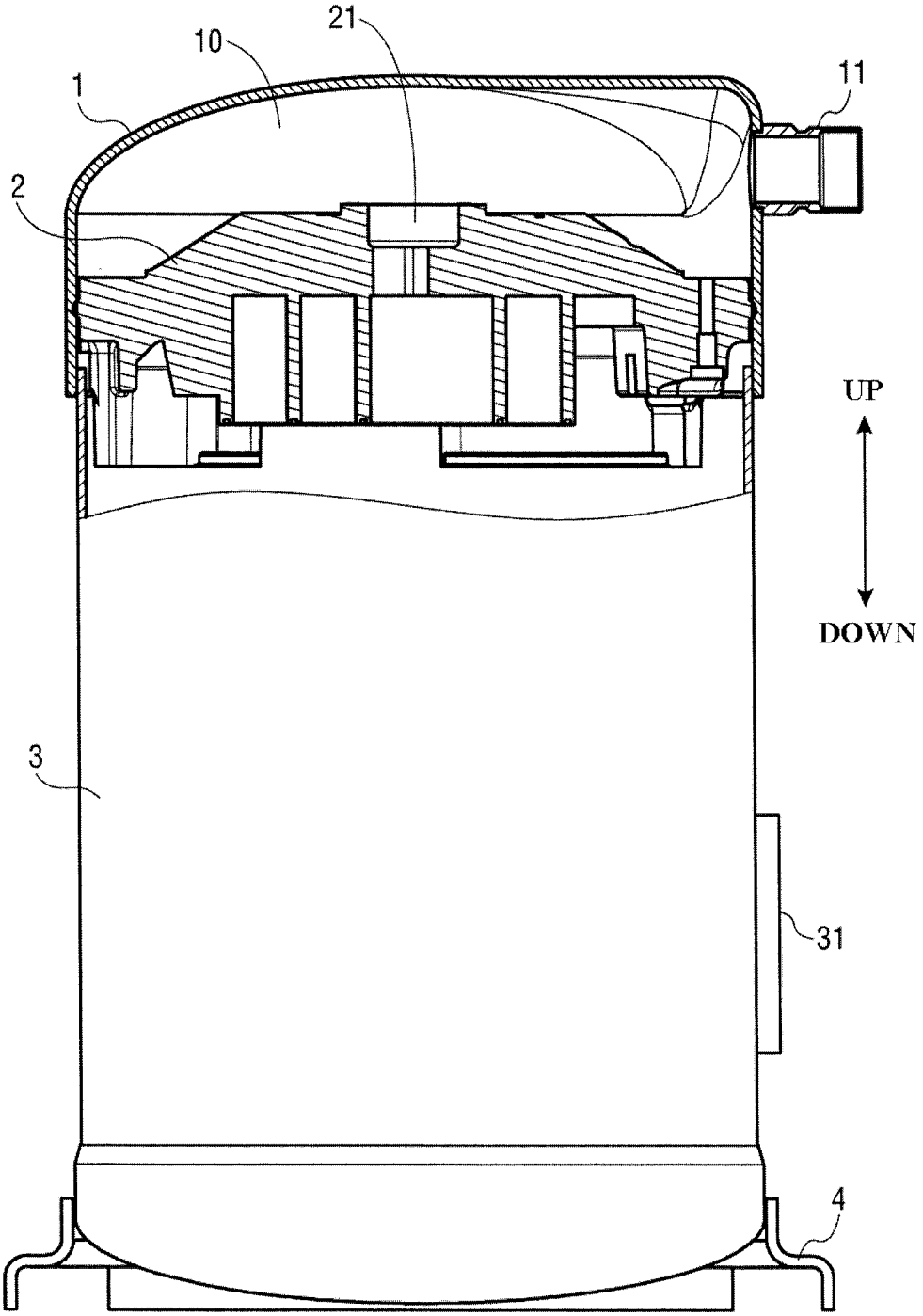
FIG. 1 is a partial cross-sectional side view of a scroll compressor.

FIG. 1 shows a partial cross-sectional side view of a scroll compressor. The scroll compressor has an upper cap 1, a middle housing 3, and a base 4. The middle housing 3 is provided on a base 4. The upper cap 1 is provided on the middle housing 3. A fluid outlet 11 is disposed on the upper cap 1, and a fixed scroll 2 is provided inside the upper cap 1. A fluid inlet 31 is disposed on the middle housing 3, and an orbiting scroll (not shown in FIG. 1) cooperating with the fixed scroll 2 is provided inside the middle housing 3. The upper cap 1 has a wall portion 12 extending downward, and a fluid outlet 11 is disposed on the upper cap 1. A pressure chamber 10 is enclosed by the fixed scroll 2 and the upper cap 1.

Figure 2:
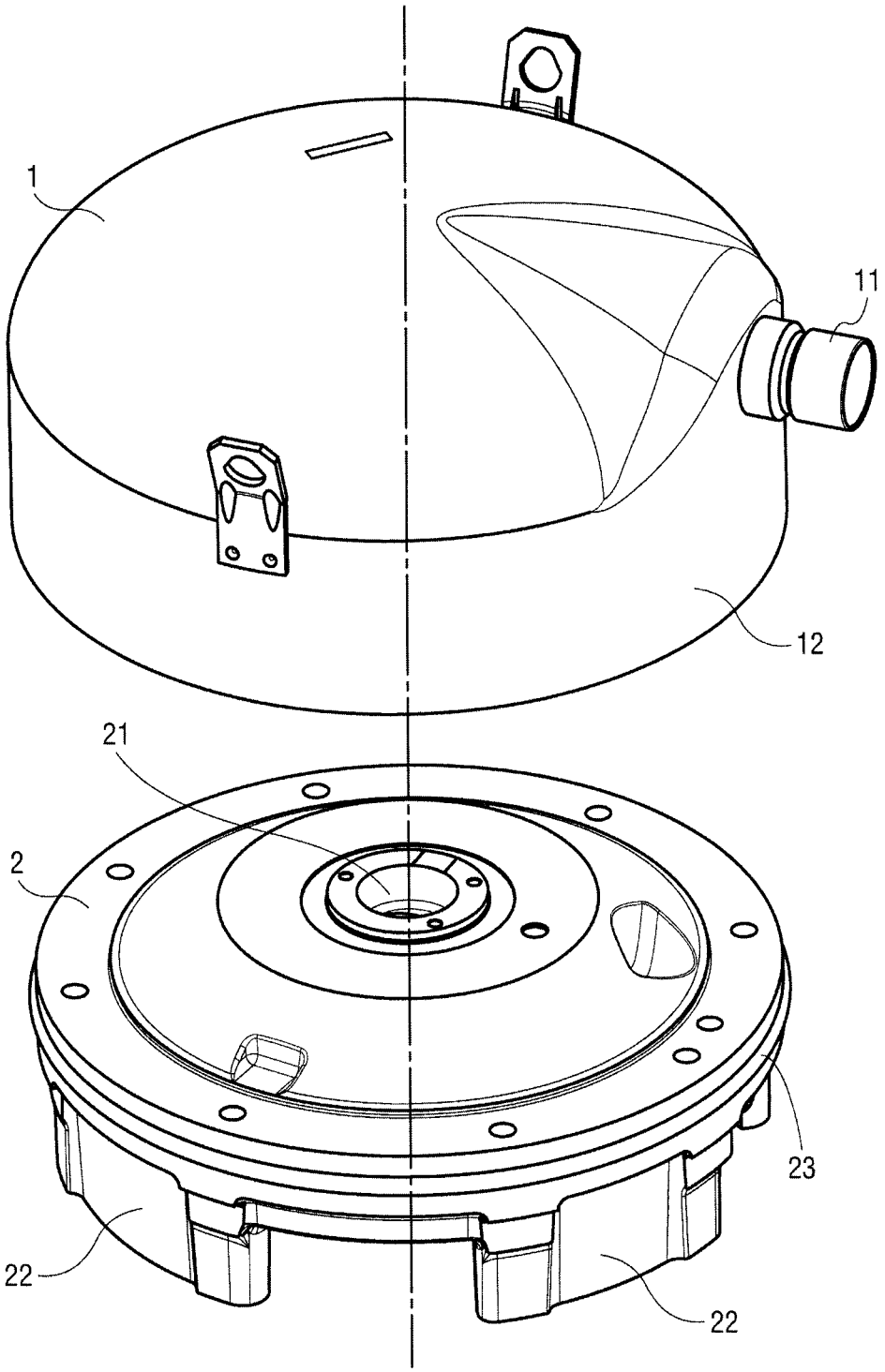
FIG. 2 is an exploded perspective view of the upper cap and the fixed scroll of the scroll compressor illustrated in FIG. 1.
Figure 3:
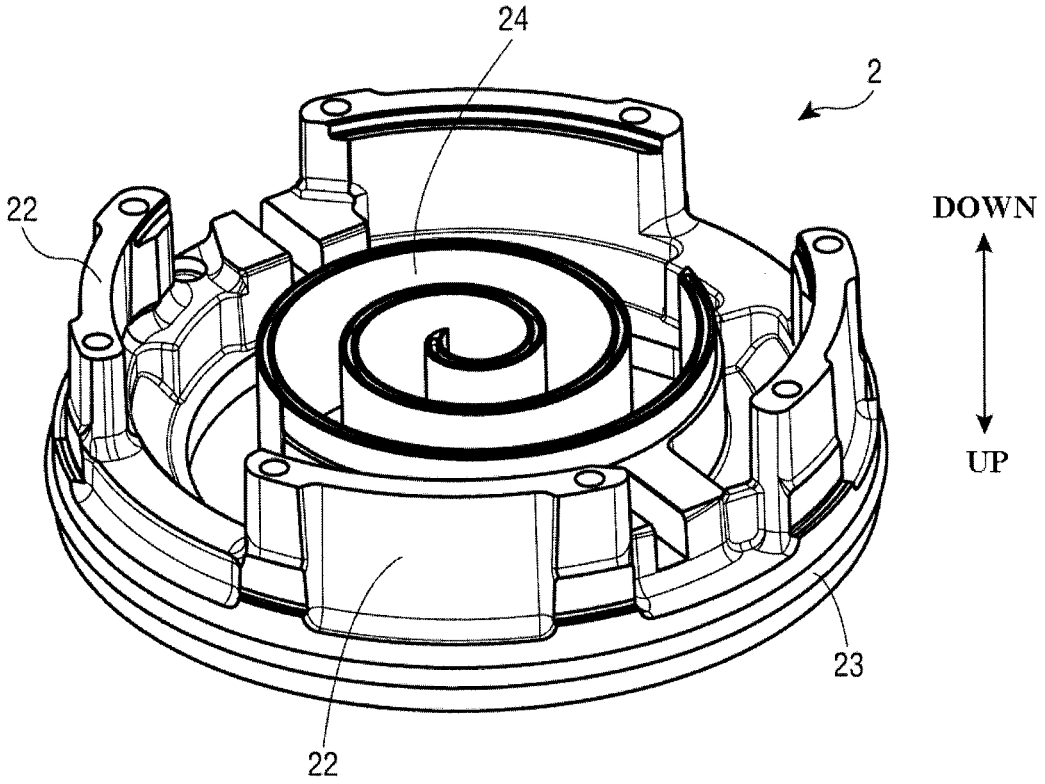
FIG. 3 is a bottom perspective view of the fixed scroll of FIG. 2.

FIG. 2 shows an exploded perspective view of the upper cap 1 and the fixed scroll 2 of the scroll compressor illustrated in FIG. 1. FIG. 3 shows a bottom perspective view of the fixed scroll 2 of FIG. 2. The fixed scroll 2 has a disc-shaped main body which is generally circular, a through hole 21 at the center of the disc-shaped main body, a wrap 24 extending downward from the lower surface of the disc-shaped main body, and a plurality of mounting portions 22 located around the wrap 24. The plurality of mounting portions 22 are located substantially below the outer periphery of said fixed scroll 2. The wrap 24 is spiral when viewed in the axial direction of said fixed scroll 2.

The fluid may enter the middle housing 3 via the fluid inlet 31, then enter the pressure chamber 10 via the through hole 21 at the center of the fixed scroll 2 pushed by the orbiting scroll, and finally be discharged to the external of the scroll compressor via the fluid outlet 11 disposed on the upper cap 1.

Figure 4:
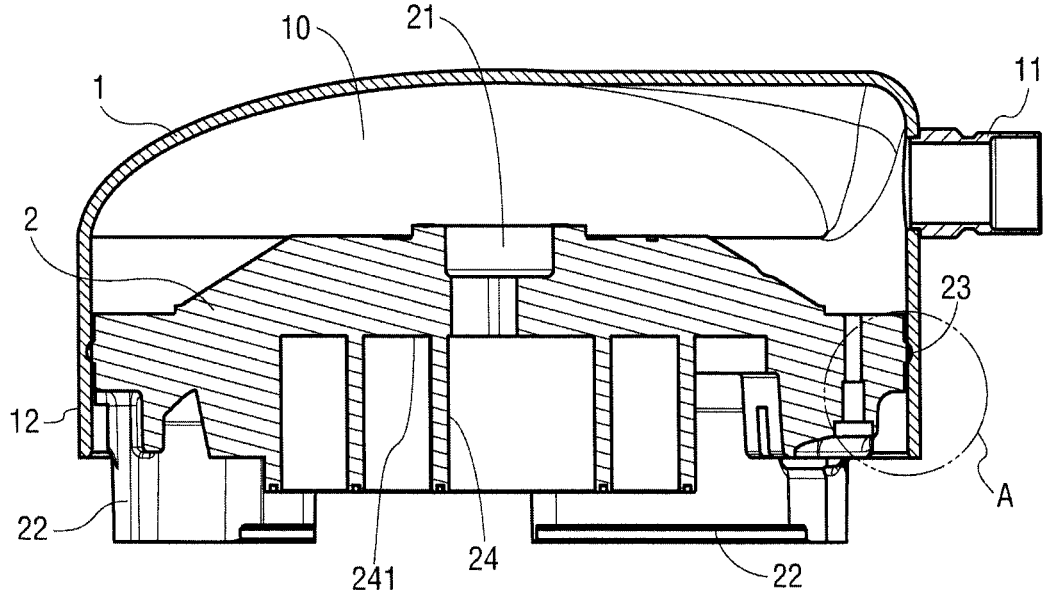
FIG. 4 is a cross-sectional side view of the upper cap and the fixed scroll of FIG. 2 in assembled state.
Figure 5:
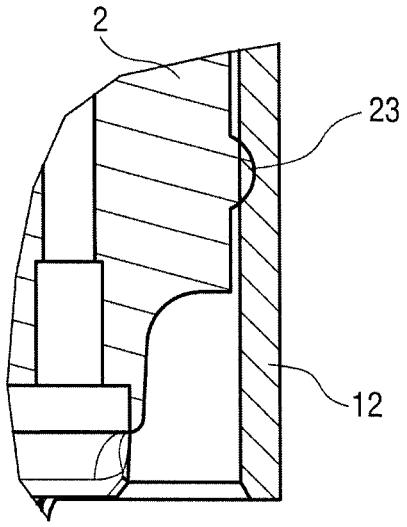
FIG. 5 is an enlarged view of the region A of FIG. 4.

FIG. 4 shows a cross-sectional side view of the upper cap and the fixed scroll of FIG. 2 in assembled state. FIG. 5 is an enlarged view of the region A of FIG. 4. In such a scroll compressor, in order to suppress the deformation of the fixed scroll 2, one shrink belt 23 is provided around the outer periphery of said fixed scroll 2 between the outer periphery of said fixed scroll 2 and the inner wall surface (wall portion 12) of the upper cap 1. The shrink belt 23 is annular and is adapted to be in interference fit between the outer periphery of said fixed scroll 2 and the inner wall surface of the upper cap 1. In the vertical direction, as shown in FIGS. 4 and 5, the height at which the shrink belt 23 is located is equal to or slightly lower than the height at which the top surface 241 of the wrap 24 is located.

Figure 6:
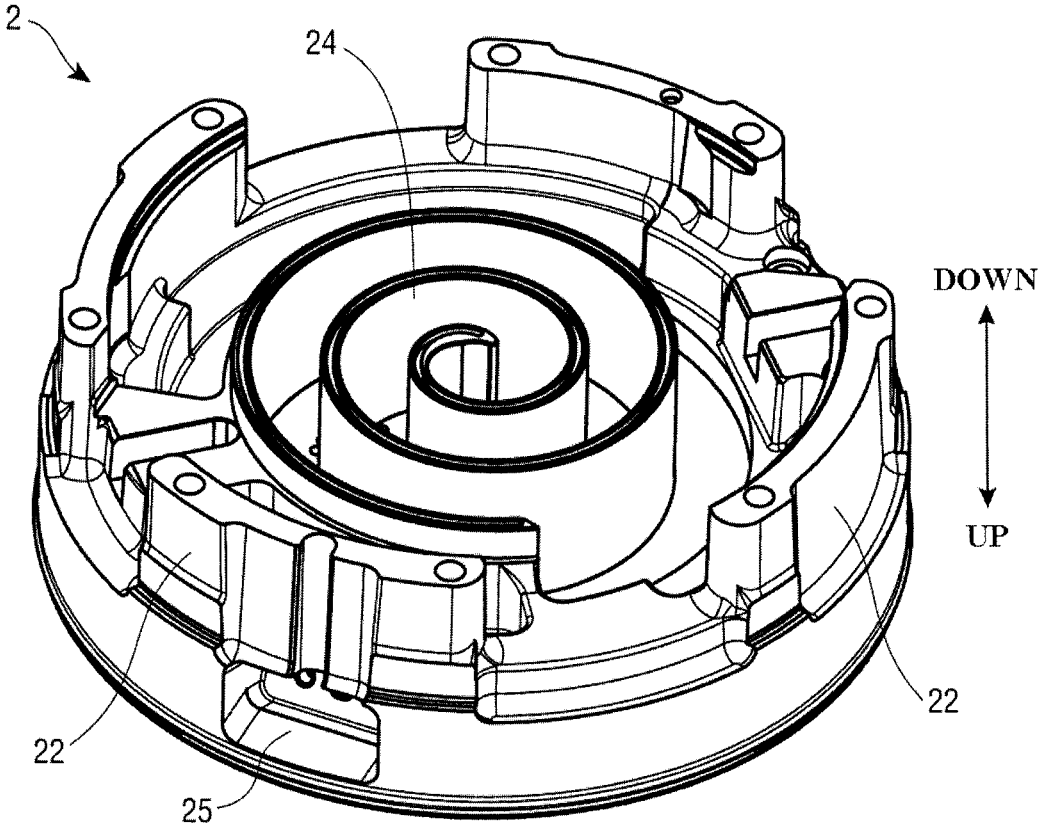
FIG. 6 is a perspective view of a fixed scroll with additional fluid passage(s)

FIG. 6 is a perspective view of a fixed scroll 2 with an additional fluid passage 25. The additional fluid passage 25 is provided in the outer periphery of the mounting portions 22 and the fixed scroll 2. In this case, in order to prevent the interference between the shrink belt 23 and the fluid passage 25, it is required to adjust the location of the shrink belt 23, more specifically, to adjust the height at which the shrink belt 23 is located in the vertical direction. As a result, such adjustment will result in an increase in the amount of the deformation of the fixed scroll 2, which in turn affects the performance and the reliability of the scroll compressor.

Hereinafter, a scroll compressor according to embodiments of the present invention will be further described with reference to FIGS. 7 to 18.

First Embodiment

Figure 7:
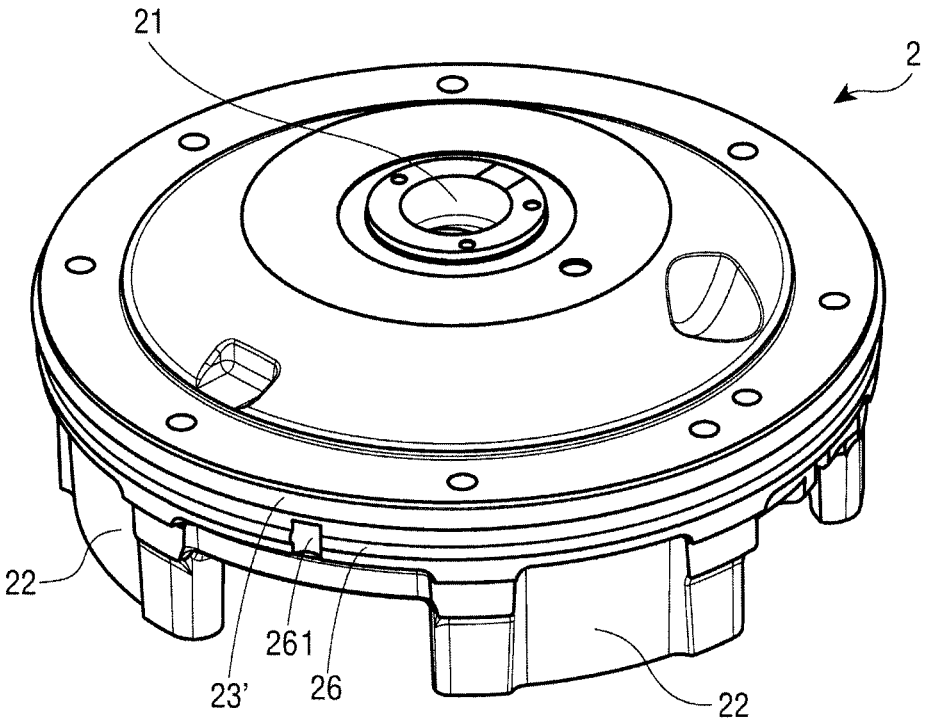
FIG. 7 is a front perspective view of a fixed scroll of a scroll compressor according to the first embodiment of the present invention.
Figure 8:
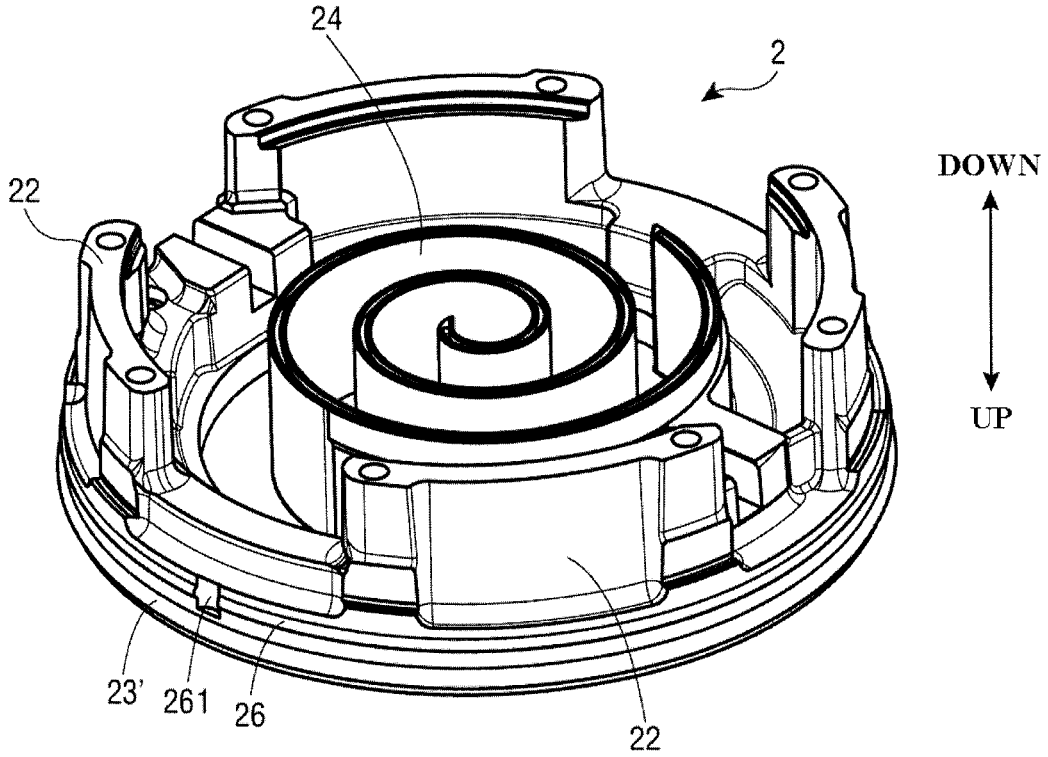
FIG. 8 is a bottom perspective view of the fixed scroll of the scroll compressor according to the first embodiment of the present invention.
Figure 9:
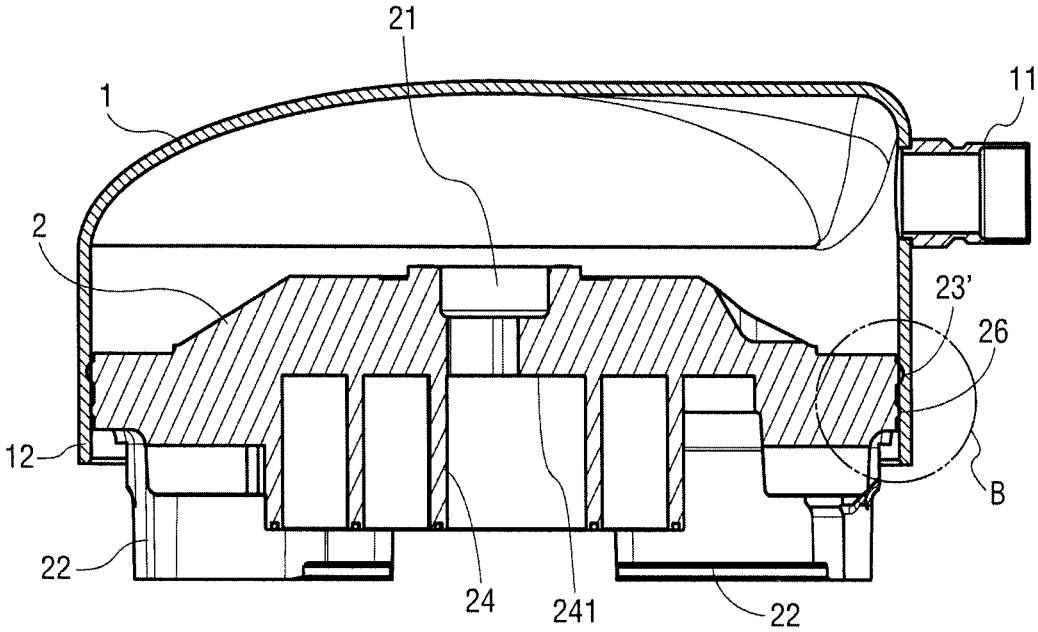
FIG. 9 is a cross-sectional side view of an upper cap and the fixed scroll of the scroll compressor in assembled state according to the first embodiment of the present invention.
Figure 10:
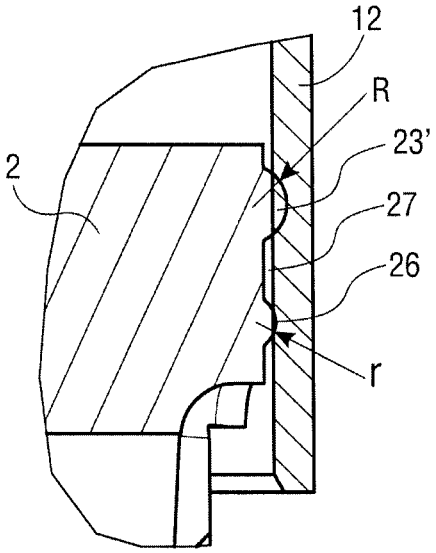
FIG. 10 is an enlarged view of the region B of FIG. 9.

FIGS. 7 and 8 are perspective views of the fixed scroll 2 of the scroll compressor according to the first embodiment of the present invention. FIG. 9 is a cross-sectional side view of an upper cap 1 and a fixed scroll 2 according to the present embodiment in assembled state. FIG. 10 is an enlarged view of the region B of FIG. 9.

Specifically, due to the reasons such as addition of other additional structure (e.g., a fluid passage), in the vertical direction, the height at which the shrink belt (hereinafter referred to as main shrink belt) 23' on the fixed scroll 2 of the scroll compressor according to the present embodiment is located is higher than the height at which the shrink belt 23 on the fixed scroll 2 of the scroll compressor shown in FIG. 4 is located. In order to suppress the deformation of the fixed scroll 2, at least one assistant shrink belt 26 is added below the main shrink belt 23' on the basis that the main shrink belt 23' is provided. In other words, at least two shrink belts 23', 26 are provided around the outer periphery of said fixed scroll 2 between the outer periphery of said fixed scroll 2 and the inner wall surface of the upper cap 1. Both of these two shrink belts 23', 26 are annular, and are adapted to be in interference fit between the outer periphery of said fixed scroll 2 and the inner wall surface (wall portion 12) of the upper cap 1.

As shown in FIGS. 9 and 10, the main shrink belt 23' and the assistant shrink belt 26 are arranged side by side in the axial direction (i.e., in the vertical direction) of the fixed scroll 2, and the main shrink belt 23' and the assistant shrink belt 26 are spaced apart from each other by a distance such that annular space 27 is enclosed by the main shrink belt 23', the inner wall surface of the upper cap 1, the assistant shrink belt 26, and the outer periphery of said fixed scroll 2 together.

Preferably, as shown in FIGS. 7 and 8, at least one notch 261 may be disposed on the assistant shrink belt 26, thereby allowing the annular space 27 to communicate with a space external to the assistant shrink belt 26, thus facilitating the evacuation of the interior of the scroll compressor comprising the annular space 27.

In this way, the main shrink belt 23' has an effect of maintaining the sealing between the space above the main shrink belt 23' and the space below the main shrink belt 23' in addition to the effect of suppressing the deformation of the fixed scroll 2. Accordingly, the assistant shrink belt 26 only functions as suppressing the deformation of the fixed scroll 2.

In the present embodiment, the shrink belts 23', 26 are separate members relative to the fixed scroll 2 and the inner wall surface of the upper cap 1.

In this case, if the shrink belts 23', 26 are made of metallic material, the shrink belts 23', 26 may be hermetically combined together with one of the outer periphery of said fixed scroll 2 and the inner wall surface of the upper cap 1 by welding. If the shrink belts 23', 26 are made of non-metallic material such as plastic, grooves may be formed on one of the outer periphery of said fixed scroll 2 and the inner wall surface of the upper cap 1, and the shrink belts 23', 26 are embedded in the grooves so as to be hermetically combined together with the outer periphery of said fixed scroll 2 or the inner wall surface of the upper cap 1 on which the grooves are formed.

Further, when the shrink belts 23', 26 are separate members relative to the outer periphery of said fixed scroll 2 and the inner wall surface of the upper cap 1, the material forming the shrink belts 23', 26 may be the same as or different from the material forming the fixed scroll 2 or the inner wall surface of the upper cap 1.

As shown in FIG. 10, the respective cross section of the main shrink belt 23' and the assistant shrink belt 26 is a circle or a part of a circle, and the radius R of the cross section of the main shrink belt 23' is larger than the radius r of the cross section of the assistant shrink belt 26. It is contemplated that the respective cross section of the main shrink belt 23' and the assistant shrink belt 26 may also have other suitable shapes, such as rectangular or oval.

In this embodiment, the assistant shrink belt 26 is located below the main shrink belt 23'. More specifically, the height at which the main shrink belt 23' is located is higher than the height at which the top surface 241 of the wrap 24 is located, while the height at which the assistant shrink belt 26 is located is lower than the height at which the top surface of the wrap 24 is located.

The technical solution of the present invention can suppress the deformation of the fixed scroll 2 effectively, and improve the performance and the reliability of the scroll compressor.

Second Embodiment

The above describes a technical solution that can be adopted in a case where additional structure is added to the fixed scroll 2. However, the present invention is not limited to this.

As an example of another embodiment, the deformation of the fixed scroll 2 may be caused for example upon the upper cap 1 is thermally assembled. In order to suppress such deformation, an assistant shrink belt may be added to the outer periphery of said fixed scroll 2 similar to the previously described embodiment, and the position of the assistant shrink belt may be determined depending on the position of the main shrink belt.

Figure 11:
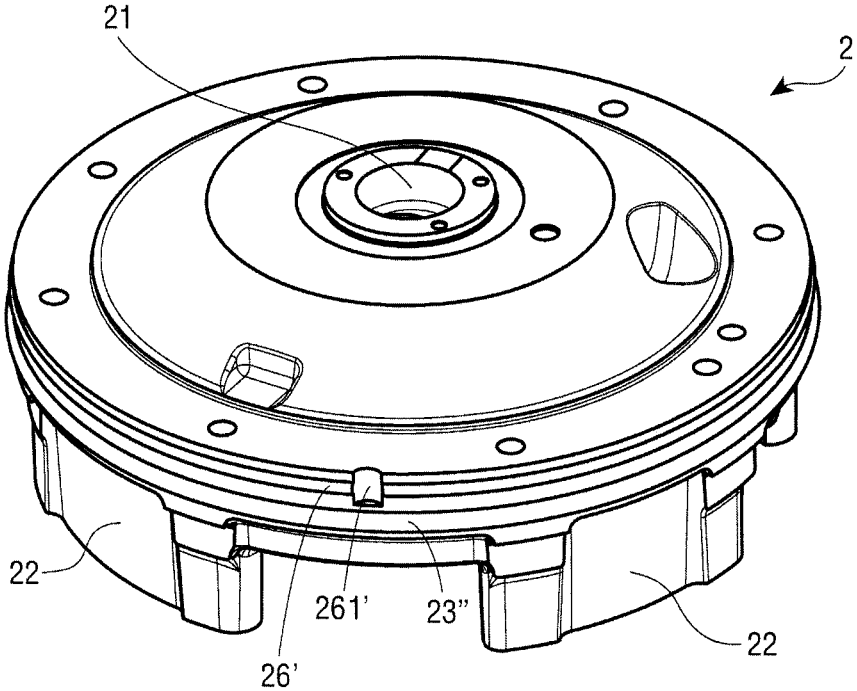
FIG. 11 is a front perspective view of a fixed scroll of a scroll compressor according to the second embodiment of the present invention.
Figure 12:
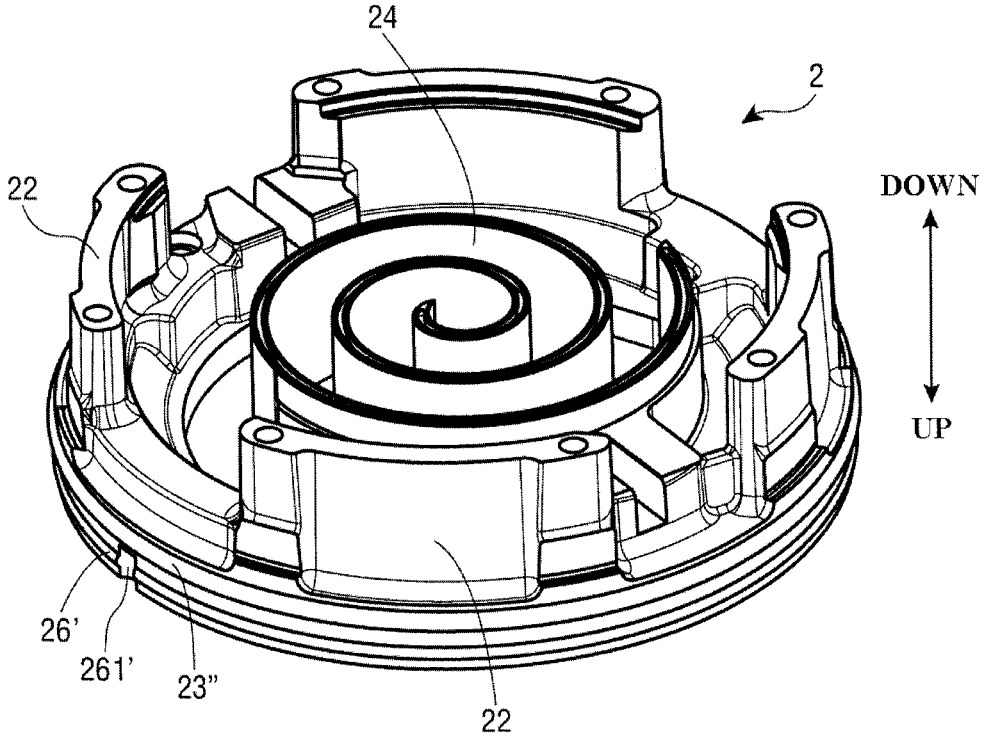
FIG. 12 is a bottom perspective view of the fixed scroll of the scroll compressor according to the second embodiment of the present invention.
Figure 13:
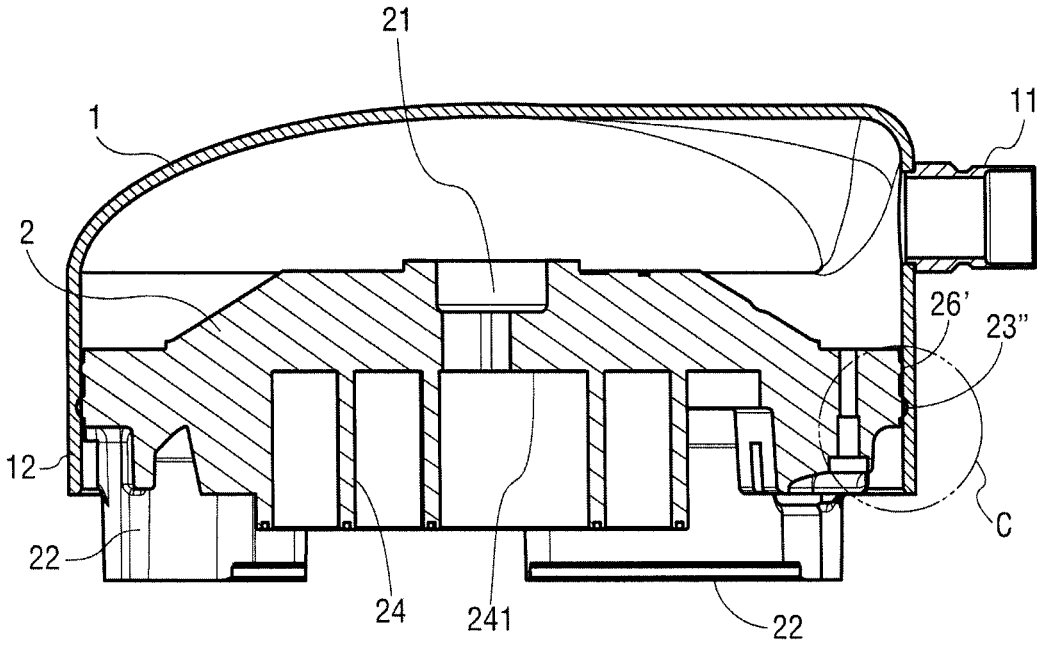
FIG. 13 is a cross-sectional side view of an upper cap and the fixed scroll of the scroll compressor in assembled state according to the second embodiment of the present invention.
Figure 14:
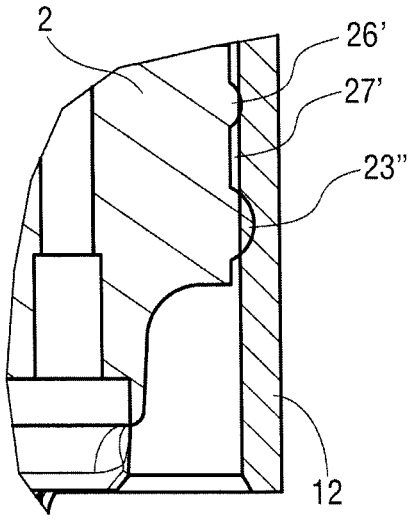
FIG. 14 is an enlarged view of the region C of FIG. 13.

FIGS. 11 and 12 are perspective views of a fixed scroll of a scroll compressor according to the second embodiment of the present invention. FIG. 13 is a cross-sectional side view of an upper cap and a fixed scroll of a scroll compressor in assembled state according to the second embodiment of the present invention. FIG. 14 is an enlarged view of the region C of FIG. 13.

The embodiment shown in FIGS. 11 to 14 is substantially identical to the embodiment shown in FIGS. 7 to 10, the difference mainly lies in that the position of the main and assistant shrink belts is reversed. In the embodiment shown in FIGS. 7 to 10, the main shrink belt 23' is located above the assistant shrink belt 26. However, in the embodiment shown in FIGS. 11 to 14, the main shrink belt 23" is located below the assistant shrink belt 26'.

Similarly, annular space 27' is enclosed by the main shrink belt 23", the inner wall surface of the upper cap 1, the assistant shrink belt 26', and the outer periphery of said fixed scroll 2 together. In addition, as shown in FIGS. 11 and 12, at least one notch 261' may be disposed on the assistant shrink belt 26', thereby allowing the annular space 27' to communicate with a space external to the assistant shrink belt 26'.

Third Embodiment

Alternatively, the inner wall surface of the upper cap 1 and the shrink belt are configured to form an integral member, that is, the shrink belt may be formed integrally with the inner wall surface of the upper cap 1.

Figure 15:
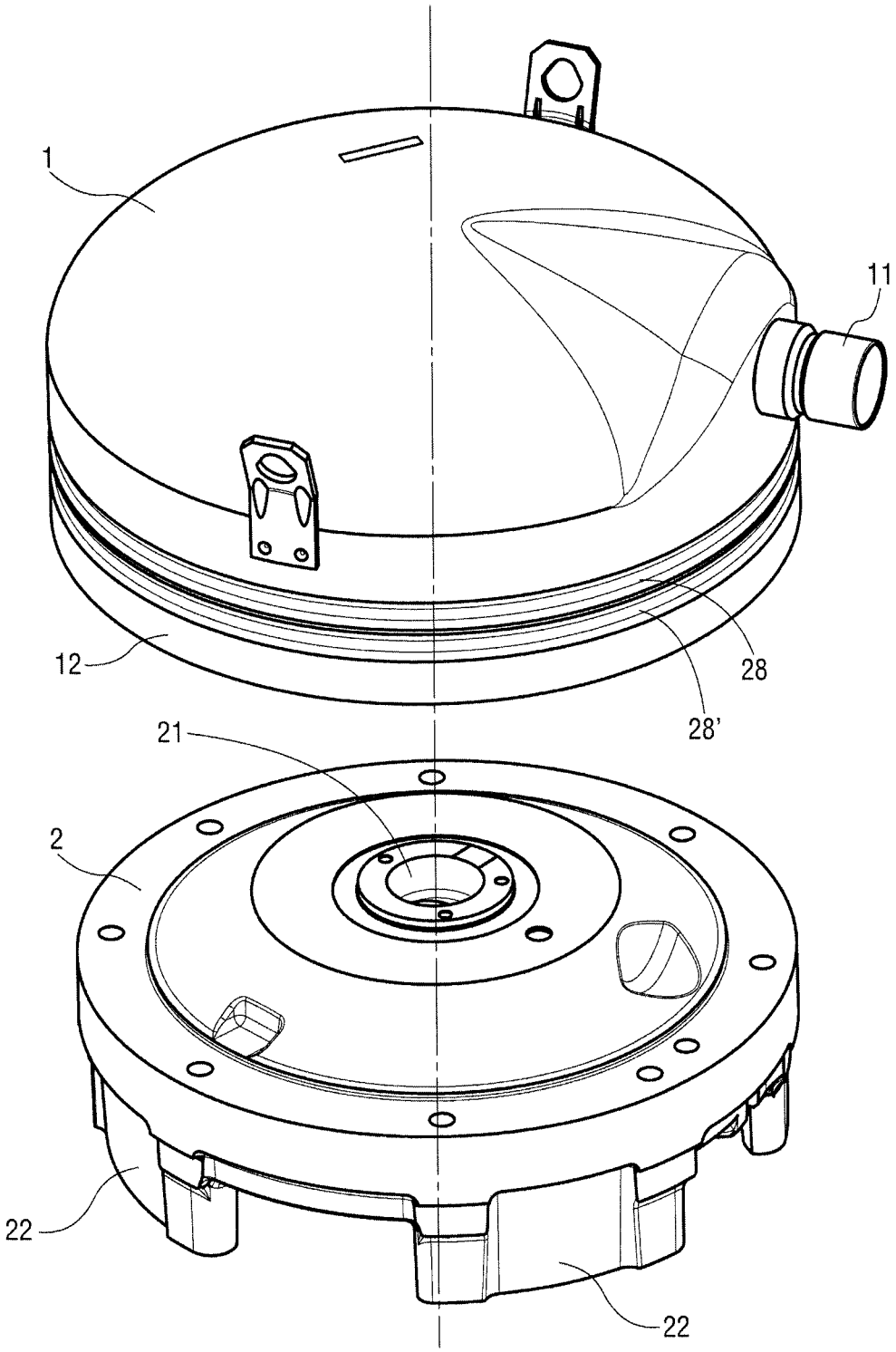
FIG. 15 is an exploded perspective view of an upper cap and a fixed scroll of a scroll compressor according to the third embodiment of the present invention.
Figure 16:
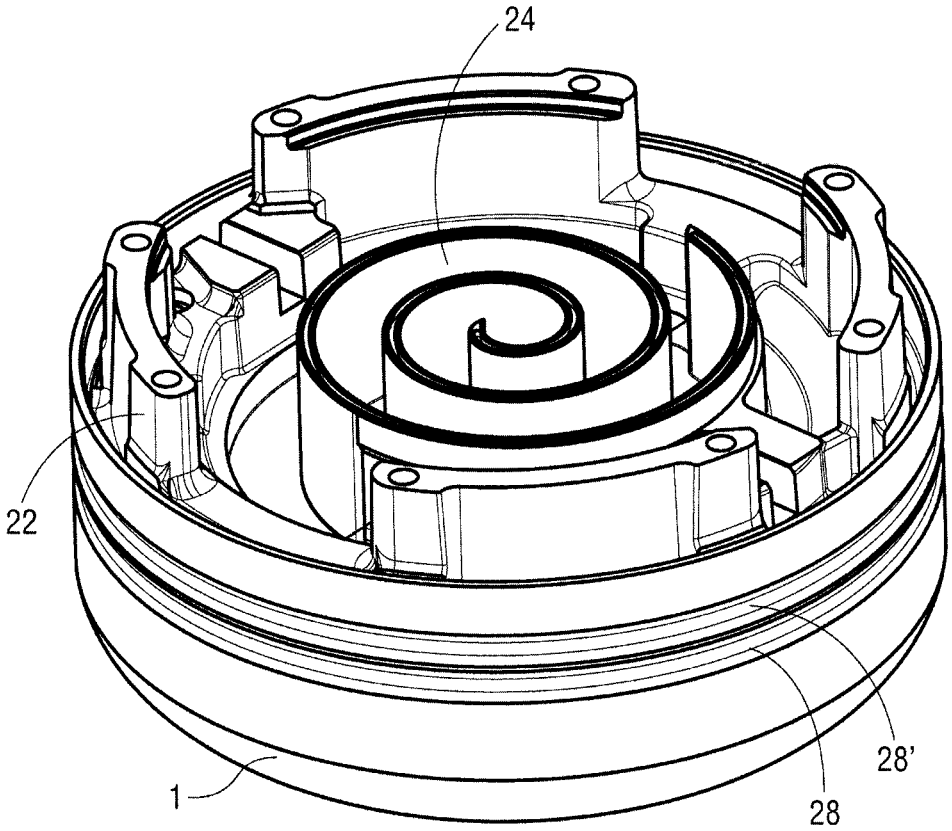
FIG. 16 is a bottom perspective view of the upper cap and the fixed scroll of FIG. 15 in assembled state.
Figure 17:
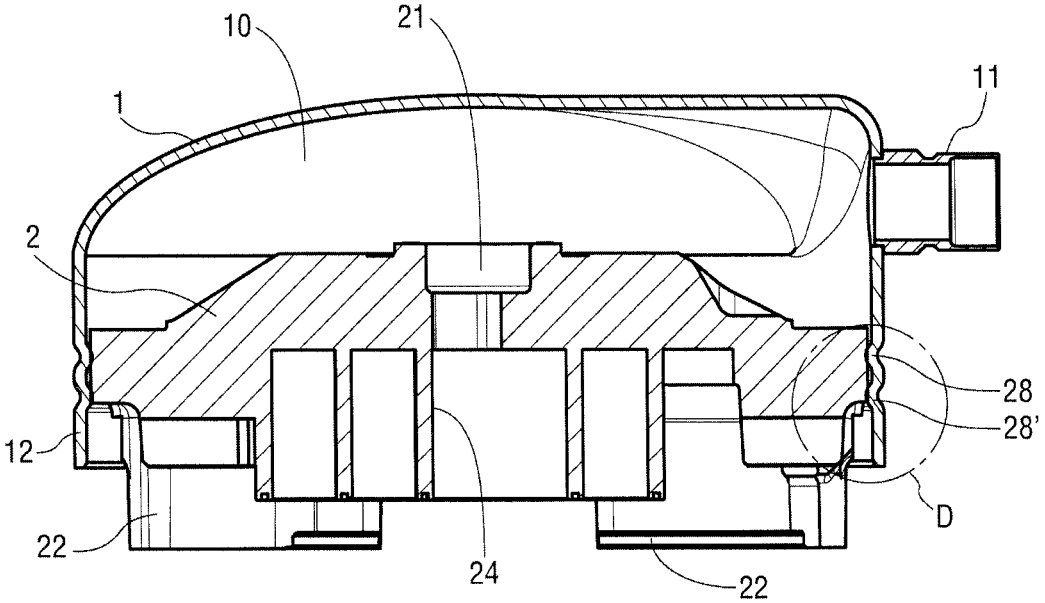
FIG. 17 is a cross-sectional side view of the upper cap and the fixed scroll of FIG. 15 in assembled state.
Figure 18:
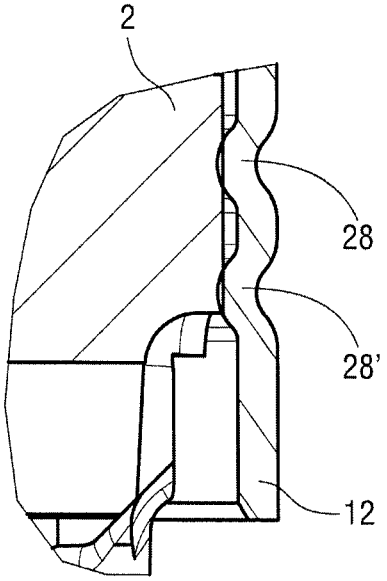
FIG. 18 is an enlarged view of the region D of FIG. 17.

FIG. 15 is an exploded perspective view of an upper cap and a fixed scroll of a scroll compressor according to the third embodiment of the present invention. FIG. 16 is a bottom perspective view of the upper cap and the fixed scroll of FIG. 15 in assembled state. FIG. 17 is a cross-sectional side view of the upper cap and the fixed scroll of FIG. 15 in assembled state. FIG. 18 is an enlarged view of the region D of FIG. 17.

The third embodiment shown in FIGS. 15 to 18 mainly differs from the first and second embodiments in that the main shrink belt 28 and the assistant shrink belt 28' are formed on the wall portion 12 of the upper cap 1, rather than on the outer periphery of said fixed scroll 2.

Specifically, as shown in FIGS. 15 to 18, the inner wall surface (wall portion 12) of the upper cap 1 is recessed inward in the radial direction, in other words, the inner wall surface of the upper cap 1 protrudes inward towards the fixed scroll 2, thereby forming the annular main shrink belt 28 and the assistant shrink belt 28'. The main shrink belt 28 and the assistant shrink belt 28' can abut on the outer periphery of said fixed scroll 2, thus achieving sealing therebetween, and suppressing the deformation of the fixed scroll 2, thereby improving the performance and the reliability of the scroll compressor.

It should be understood that the technical features of the first embodiment and the second embodiment may be applied to the third embodiment individually or in combination without significant collision or conflict. For example, at least one notch similar to the notches 261, 261' described above may also be disposed on the assistant shrink belt 28' (the notch is not shown in FIGS. 15 to 18). Additionally, for example, the radius of the cross section of the main shrink belt 28 is larger than the radius of the cross section of the assistant shrink belt 28'.

The technical object, technical solutions, and technical effects of the present invention are described in detail above with reference to specific embodiments. It should be understood that the above described embodiments are illustrative only, and not restrictive. Any modifications, equivalent substitutions, improvements and the like made by those skilled in the art within the spirit and principles of the present invention are intended to be included within the scope of the present invention.

What is claimed is:

1. A scroll compressor, comprising an upper cap in which a fixed scroll is provided, wherein at least two shrink belts are provided around an outer periphery of said fixed scroll between the outer periphery of said fixed scroll and an inner wall surface of the upper cap, and the at least two shrink belts are annular, and are in interference fit between the outer periphery of said fixed scroll and the inner wall surface of the upper cap, wherein at least one notch is disposed on at least one of the shrink belts.

2. The scroll compressor according to claim 1, wherein, the at least two shrink belts comprise a main shrink belt and an assistant shrink belt, and the respective cross section of the main shrink belt and the assistant shrink belt is a circle or a part of a circle.

3. The scroll compressor according to claim 2, wherein, the main shrink belt and the assistant shrink belt are arranged side by side in an axial direction of said fixed scroll, and the main shrink belt and the assistant shrink belt are spaced apart from each other by a distance such that annular space is enclosed by the main shrink belt, the inner wall surface of the upper cap, the assistant shrink belt and the outer periphery of said fixed scroll together.

4. The scroll compressor according to claim 3, wherein, a radius of the cross section of the main shrink belt is larger than a radius of the cross section of the assistant shrink belt.

5. The scroll compressor according to claim 4, wherein, one of the fixed scroll and the inner wall surface of the upper cap is formed integrally with the shrink belts.

6. The scroll compressor according to claim 3, wherein, the at least one notch is disposed on the assistant shrink belt, thereby allowing the annular space to communicate with a space external to the assistant shrink belt.

7. The scroll compressor according to claim 6, wherein, one of the fixed scroll and the inner wall surface of the upper cap is formed integrally with the shrink belts.

8. The scroll compressor according to claim 3, wherein, the fixed scroll has a disc-shaped main body, a through hole at a center of the main body, a wrap extending downward from the lower surface of the main body, and a plurality of mounting portions located around the wrap.

9. The scroll compressor according to claim 8, wherein, the assistant shrink belt is located above or below the main shrink belt.

10. The scroll compressor according to claim 9, wherein, one of the fixed scroll and the inner wall surface of the upper cap is formed integrally with the shrink belts.

11. The scroll compressor according to claim 8, wherein, in the axial direction of said fixed scroll, a height at which a central plane of the main shrink belt is located is higher than a height at which a top surface of the wrap is located, and a height at which a central plane of the assistant shrink belt is located is lower than the height at which the top surface of the wrap is located.

12. The scroll compressor according to claim 8, wherein, the plurality of mounting portions are located below the outer periphery of said fixed scroll, and a fluid passage is provided in the outer periphery of said fixed scroll and at least one of the plurality of mounting portions.

13. The scroll compressor of claim 8, further comprising a middle housing and a base, wherein the middle housing is provided on the base, and the upper cap is provided on the middle housing, a fluid inlet is disposed on the middle housing, and an orbiting scroll cooperating with the fixed scroll is disposed inside the middle housing, a pressure chamber is enclosed by the fixed scroll and the upper cap, and a fluid outlet is disposed on the upper cap so that fluid enters the middle housing via the fluid inlet, then enters the pressure chamber via the through hole disposed at the center of the fixed scroll, and finally is discharged to the external of the scroll compressor via the fluid outlet disposed on the upper cap.

14. The scroll compressor according to claim 8, wherein, one of the fixed scroll and the inner wall surface of the upper cap is formed integrally with the shrink belts.

15. The scroll compressor according to claim 3, wherein, one of the fixed scroll and the inner wall surface of the upper cap is formed integrally with the shrink belts.

16. The scroll compressor according to claim 2, wherein, one of the fixed scroll and the inner wall surface of the upper cap is formed integrally with the shrink belts.

17. The scroll compressor according to claim 1, wherein, one of the fixed scroll and the inner wall surface of the upper cap is formed integrally with the shrink belts.

18. The scroll compressor according to claim 1, wherein, the shrink belts are separate members relative to the fixed scroll and the inner wall surface of the upper cap, and grooves are formed on one of the outer periphery of said fixed scroll and the inner wall surface of the upper cap, in which the shrink belts are embedded.

19. The scroll compressor according to claim 17, wherein, the shrink belts and the inner wall surface of the upper cap are formed integrally, and the shrink belts are formed by an inner wall surface of the upper cap that protrudes towards the fixed scroll.

20. The scroll compressor according to claim 1, wherein, the shrink belts are separate members relative to the fixed scroll and the inner wall surface of the upper cap, and the shrink belts are welded on one of the outer periphery of said fixed scroll and the inner wall surface of the upper cap.

* * * * *